US009486839B2

(12) United States Patent
Torek et al.

(10) Patent No.: US 9,486,839 B2
(45) Date of Patent: Nov. 8, 2016

(54) SCRAP METAL SORTING SYSTEM

(75) Inventors: Paul Torek, Ann Arbor, MI (US); Daniel F. Gorzen, Ypsilanti, MI (US); Kalyani Chaganti, Brownstown Township, MI (US)

(73) Assignee: Huron Valley Steel Corporation, Trenton, MI (US)

( * ) Notice: Subject to any disclaimer, the term of this patent is extended or adjusted under 35 U.S.C. 154(b) by 248 days.

(21) Appl. No.: 13/978,118

(22) PCT Filed: Jan. 6, 2012

(86) PCT No.: PCT/US2012/020432

§ 371 (c)(1),
(2), (4) Date: Jul. 2, 2013

(87) PCT Pub. No.: WO2012/094568

PCT Pub. Date: Jul. 12, 2012

(65) Prior Publication Data

US 2013/0304254 A1 Nov. 14, 2013

Related U.S. Application Data

(60) Provisional application No. 61/430,585, filed on Jan. 7, 2011.

(51) Int. Cl.

| | |
|---|---|
| ***B07C 5/00*** | (2006.01) |
| ***B07C 5/34*** | (2006.01) |
| ***B07C 5/346*** | (2006.01) |

(52) U.S. Cl.

CPC ..... *B07C 5/3416* (2013.01); *B07C 5/346* (2013.01)

(58) Field of Classification Search

CPC ..... B07C 5/342; B07C 5/346; B07C 5/3416; B07C 5/3427; G01N 23/20; G01N 23/203

USPC ..... 209/576, 579, 589; 356/316, 318, 45, 356/47; 378/70, 71

See application file for complete search history.

(56) References Cited

U.S. PATENT DOCUMENTS

| | | | |
|---|---|---|---|
| 4,317,521 | A | 3/1982 | Clark et al. |
| 5,247,561 | A | 9/1993 | Kotowski |

(Continued)

FOREIGN PATENT DOCUMENTS

| | | | |
|---|---|---|---|
| CN | 201387357 | Y | 1/2010 |
| GB | 2285506 | A | 7/1995 |

(Continued)

OTHER PUBLICATIONS

International Preliminary Report for corresponding Application No. PCT/US2012/020432, mailed Jul. 18, 2013, 6 pages.

(Continued)

*Primary Examiner* — Joseph C Rodriguez
*Assistant Examiner* — Kalyanavenkateshware Kumar
(74) *Attorney, Agent, or Firm* — Brooks Kushman P.C.

(57) ABSTRACT

An apparatus and a method for sorting scrap metal containing at least two categories of metals are provided. An x-ray beam is directed towards at least a portion of a particle of scrap metal. Backscattered x-rays, forward scattered x-rays, and transmitted x-rays from the particle are measured and input into a classifier, such as a database with a cutoff plane. The scrap metal is sorted into a first category and a second category on the scrap metal by a controller. An x-ray source for a scanning system is provided with an electron beam generator, an electromagnetic beam focusing coil, a pair of saddle shaped beam steering coils, and a target foil to create a scanning x-ray beam along a plane.

37 Claims, 6 Drawing Sheets

(56) References Cited

U.S. PATENT DOCUMENTS

| | | | | |
|---|---|---|---|---|
| 5,313,511 | A | 5/1994 | Annis et al. | |
| 5,428,657 | A | 6/1995 | Papanicolopoulos et al. | |
| 5,600,700 | A | 2/1997 | Krug et al. | |
| 5,974,111 | A | 10/1999 | Krug et al. | |
| 5,987,095 | A | 11/1999 | Chapman et al. | |
| 6,122,344 | A | 9/2000 | Beevor | |
| 6,163,592 | A | 12/2000 | He et al. | |
| 6,269,142 | B1 | 7/2001 | Smith | |
| 6,353,655 | B1 * | 3/2002 | Siochi | 378/65 |
| 6,661,867 | B2 | 12/2003 | Mario et al. | |
| 6,696,655 | B2 * | 2/2004 | Harbeck et al. | 209/571 |
| 6,735,279 | B1 | 5/2004 | Jacobs et al. | |
| 7,072,440 | B2 | 7/2006 | Mario et al. | |
| 7,203,269 | B2 | 4/2007 | Huber et al. | |
| 7,336,767 | B1 | 2/2008 | Le | |
| 7,400,706 | B2 | 7/2008 | Li et al. | |
| 7,477,725 | B2 | 1/2009 | Harding | |
| 7,551,715 | B2 | 6/2009 | Rothschild et al. | |
| 7,555,099 | B2 | 6/2009 | Rothschild et al. | |
| 7,564,943 | B2 * | 7/2009 | Sommer et al. | 378/53 |
| 7,634,054 | B2 | 12/2009 | Matoba et al. | |
| 7,646,850 | B2 | 1/2010 | MacDonald | |
| 7,680,248 | B2 | 3/2010 | Matoba | |
| 7,693,261 | B2 | 4/2010 | Robinson et al. | |
| 7,763,820 | B1 * | 7/2010 | Sommer et al. | 209/576 |
| 2004/0017888 | A1 | 1/2004 | Seppi et al. | |
| 2006/0002515 | A1 | 1/2006 | Huber et al. | |
| 2006/0081510 | A1 * | 4/2006 | Kenny et al. | 209/576 |
| 2007/0030953 | A1 * | 2/2007 | Sommer et al. | 378/53 |
| 2007/0086568 | A1 | 4/2007 | Petzold, III et al. | |
| 2008/0008292 | A1 | 1/2008 | Krmar et al. | |
| 2009/0092222 | A1 | 4/2009 | Okamoto et al. | |
| 2009/0261024 | A1 | 10/2009 | Sommer, Jr. et al. | |
| 2010/0034353 | A1 | 2/2010 | Kravis et al. | |
| 2010/0067654 | A1 | 3/2010 | Kotowski et al. | |

FOREIGN PATENT DOCUMENTS

| | | | |
|---|---|---|---|
| JP | 10216651 | A | 8/1998 |
| JP | 200112949 | A | 5/2001 |

OTHER PUBLICATIONS

International Search Report for corresponding Application No. PCT/US2012/020432, mailed Aug. 24, 2012, 10 pages.

Chinese Office Action for corresponding Application No. 201280007107.8, mailed May 6, 2014, 5 pages.

* cited by examiner

SCRAP METAL SORTING SYSTEM

CROSS-REFERENCE TO RELATED APPLICATIONS

This application claims the benefit of U.S. provisional Application No. 61/430,585 filed Jan. 7, 2011, the disclosure of which is incorporated in its entirety by reference herein.

TECHNICAL FIELD

The invention relates to a method and a system for sorting scrap metals in a line operation.

BACKGROUND

Scrap metals are currently sorted at high speed or high volume using a conveyor belt or other line operations using a variety of techniques including: air sorting, vibratory sorting, color based sorting, magnetic sorting, hand sorting by a line operator, spectroscopic sorting, and the like. The scrap metals are typically shredded before sorting and require sorting to facilitate reuse of the metals. By sorting the scrap metals, metal is reused that may otherwise go to a landfill. Additionally, use of sorted scrap metal leads to reduced pollution and emissions in comparison to refining virgin feedstock from ore or plastic from oil. Scrap metals may be used in place of virgin feedstock by manufacturers if the quality of the sorted metal meets standards. The scrap metals may include types of ferrous and non-ferrous metals, heavy metals, high value metals such as nickel or titanium, cast or wrought metals, and other various alloys.

X-ray sorting technology has been used in the metal sorting industry to sort scrap metals. An x-ray sorter measures the transmitted x-rays through a piece of scrap metal using a dual energy detector. The detector is capable of measuring at least two different energy levels transmitted through the scrap metal. The sorting algorithm is based on the ratio of the two energy levels measured by the detector.

SUMMARY

In an embodiment, an apparatus for sorting scrap metals includes a conveyor belt for carrying at least two categories of scrap metals positioned at random. The conveyor belt travels in a first direction. An electron beam source creates a scanning electron beam. A target foil is positioned to interact with the electron beam source to create a scanning x-ray beam along a plane generally transverse to the first direction of the conveyer belt and directed towards the scrap metals on the conveyor belt. The apparatus includes at least one backscatter detector for measuring backscattered x-rays from the scrap metals on the conveyor belt, at least one forward scatter detector for measuring forward scattered x-rays from the scrap metals on the conveyor belt, and a transmission detector for measuring transmitted x-rays through the scrap metals on the conveyor belt. A database contains a cutoff plane between a first category of the scrap metal and a second category of the scrap metal. The cutoff plane is a function of transmission x-rays, backscatter x-rays, and forward scatter x-rays. A controller is configured to receive transmitted x-rays, forward scattered x-rays, and backscattered x-rays detected from the scrap metal as a dataset. The controller normalizes the dataset using detected x-rays from the conveyor belt. The controller then compares the normalized dataset to the cutoff plane in the database to categorizing the scrap metals into one of the first and the second category.

In another embodiment, a method for sorting scrap metals includes impinging a collimated x-ray on a background material and impinging a collimated x-ray on a portion of a piece of scrap metal provided on the background material. The scrap metal contains a first and a second category of metal. The method measures and compares transmitted x-rays from the portion of scrap metal and the background material to create a transmission ratio. The method measures and compares forward scattered x-rays from the portion of the scrap metal and the background material to create a forward scatter ratio. The method also measures and compares backscattered x-rays from the portion of the scrap metal and the background material to create a backscatter ratio. The transmission ratio and backscatter ratio are input into a database to obtain a forward scatter cutoff value, which provides a division between the first category of metal and the second category of metal. The forward scatter ratio is compared to the forward scatter cutoff value. The piece of scrap metal is sorted into one of the first category and the second category based on the cutoff value.

In yet another embodiment, an apparatus is provided for sorting scrap metal containing at least two categories of metals. The apparatus includes an x-ray beam directed towards at least a portion of a particle of scrap metal. At least one backscatter detector measures a backscattered x-ray from the particle. At least one forward scatter detector measures a forward scattered x-ray from the particle. A transmission detector measures a transmitted x-ray through the particle. A database contains a cutoff plane between a first category of the scrap metal and a second category on the scrap metal. The cutoff plane is defined as a function of transmission x-rays, backscatter x-rays, and forward scatter x-rays. A controller is configured to compare the transmitted x-ray, the forward scattered x-ray, and the backscattered x-ray from the particle of scrap metal to the cutoff plane in the database, thereby x-ray classifying the metals into at least two categories.

In another embodiment, an x-ray source for a scanning system includes an electron beam generator for creating an electron beam. An electromagnetic beam focusing coil focuses the electron beam. A pair of beam steering coils creates a scanning electron beam along a plane. A target foil interacts with the scanning electron beam to create a scanning x-ray beam along the plane.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
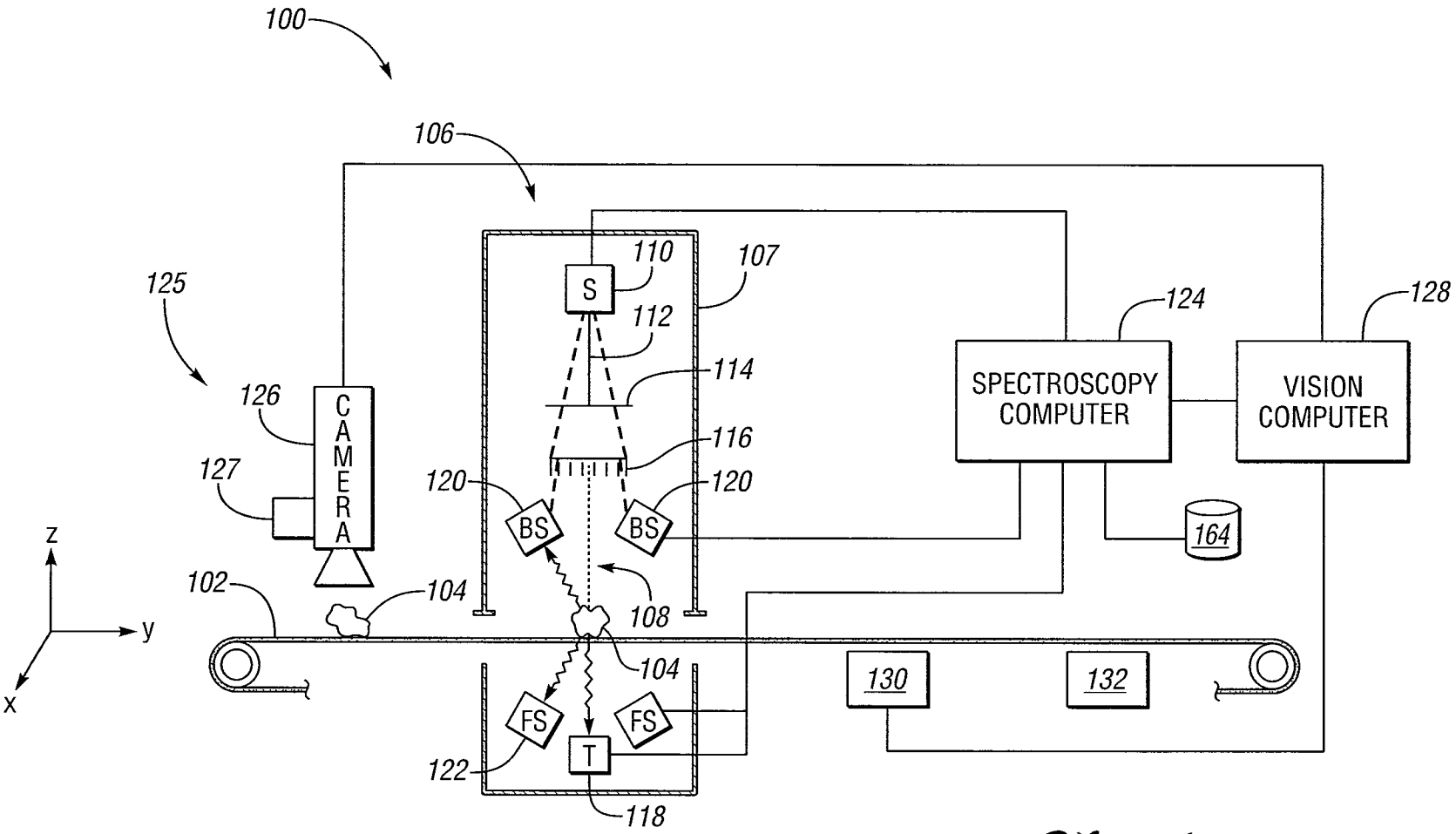
FIG. 1 is a schematic of a scrap metal sorting system according to an embodiment.

A sorting system 100 for scrap metal using x-ray spectroscopy is depicted in FIG. 1. A conveyor belt 102, or other mechanism for moving objects along a path, shown here as the y-direction, supports metals 104 to be sorted. The metals to be sorted are made up of scrap metals, such as scrap metal from a vehicle, airplane, or from a recycling center; or other solid scrap metals as are known in the art. The metals 104 are typically broken up into smaller pieces on the order of centimeters or millimeters by a shredding process, or the like, before going through the sorting system 100 or a larger sorting facility. Typically a binary sort is performed to sort the metals 104 into two categories of metals. The conveyor belt 102 extends width-wise in the x-direction, and pieces of metal 104 are positioned at random on the belt 102.

The belt 102 passes through an x-ray system 106, which produces an x-ray beam 108 that interacts with the metal 104 to produce transmitted or scattered x-rays from the metal 104. Alternatively, the belt 102 drops the metals 104 in freefall through the x-ray system 106, and the x-ray beam 108 interacts with the metals 104 as they are falling. Other systems for moving the metals 104 thru the x-ray system 106 are also contemplated. The x-ray system 106 is shielded to prevent x-rays and radiation from leaving the contained x-ray system. The shielding 107 provides a safety feature for the system 106.

An electron beam source 110 produces a scanning electron beam 112. The electron beam 112 is directed towards the conveyor belt 102 and scans along a plane generally transverse to the traveling direction (y) of the belt 102. The electron beam source 110 is located within a vacuum chamber, as is known in the art, to prevent dispersion of the electron beam 112. The electron beam 112 interacts with a target foil 114 to produce a scanning x-ray beam 108 generally in a plane in the x-direction, which may be the same plane as the scanning electron beam 112. The target foil on the order of several mils of thickness and is made from tantalum, titanium with tungsten powder, carbon with tungsten powder, or others as are known in the art for producing an x-ray beam.

The scanning x-ray beam 108 passes through a beam collimator 116 to allow only the portion of x-ray beams 108 that are traveling generally perpendicular to the belt 102, or generally in the z-direction, to pass through.

The collimated x-ray beam 108 then travels towards the belt 102. The beam 108 either interacts with a region of the belt 102 without any metal 104 positioned on it, or a region of the belt 102 with metal 104 positioned on it. The x-ray beam 108 will interacts with the belt 102 alone or with the metal 104 on the belt 102 and the underlying belt 102. A portion of the x-ray 108 is transmitted through belt 102 alone or the metal 104 and belt 102 to a transmission detector 118 located beneath the belt 102. The transmission detector 118 is aligned with the plane of the scanning x-ray beam 108, generally in the x-direction.

Another portion of the x-ray 108 which interacts with the belt 102 or the metal 104 is backscattered, and is measured by a pair of backscatter detectors 120, although the use of only one detector 120 is also contemplated. Two detectors 120 are used to increase the signal-to-noise of the backscattered x-ray measurement. The detectors 120 may be located at equal angles from the plane of the incident x-ray beam 108. For example, the detectors 120 are positioned adjacent to the plane of scanning x-rays 108, and may be as close to the electron source 110 as is practically possible.

A thin layer, such as a film or coating, of Niobium, or other atomic metal, may be added to the surface of the backscatter detectors 120 to eliminate or reduce fluorescence radiation emitted from the metal 104.

A third portion of the x-ray 108 interacting with the belt 102 or the metal 104 is forward scattered, and is measured by a pair of forward scatter detectors 122, although the use of only one detector is also contemplated. The detectors 122 may be located at equal angles from the plane of the incident x-ray beam 108. For example, the detectors 122 are positioned adjacent to the plane of scanning x-rays 108, and may be as close to the transmission detector 118 as is practically possible.

Typically, the transmission detector 118 receives the highest signal strength, followed by the backscatter detectors 120, and then the forward scatter detectors 122. The detectors 118, 120, 122 may measure one or both of Rayleigh (elastic) and Compton (inelastic) scattering. The detectors 118, 120, 122 are scintillators with photomultiplier tubes (PMTs) or other detectors located at one or both ends of the scintillator. The PMTs may be set to different levels based on the expected signal measurements to be taken. Of course, other detectors, such as photodiodes, or other photodetectors, are also contemplated.

A controller 124 receives a dataset which includes a transmission x-ray measurement, a forward scatter measurement, and a back scatter measurement taken from a region of metal 104 on the belt 102. The controller 124 may include two data acquisition boards, one for the detector data and one for the source 110 and electron beam 112 steering for the scan. The controller 124 provides a normalized dataset by normalizing the dataset from metal 104 with a dataset from the belt 102 alone, which are x-ray measurements from each detector taken from a location on the belt 102 with no metal 104 present. This normalization serves as a background noise correction for metal 104 the dataset since the belt 102 absorbs a small amount and scatters a small to moderate amount of x-rays. The normalized dataset is compared to a cutoff plane stored in a database, thereby categorizing the metal 104 into one of several categories.

The database is connected to or contained within the controller 124 and provides a cutoff plane between metals of a first and second category of the metal 104. The cutoff plane is a function of transmission x-rays, forward scatter x-rays, and backscatter x-rays, and is described in more detail below.

An imaging system 125 comprises an imaging device 126, such as a charge coupled device (CCD) camera, and an appropriate lighting system 127. The imaging system 125 is located upstream of the x-ray system 106. The imaging device 126 is positioned to image the belt 102 and any metals 104 located on the belt 102. The imaging system 125 helps determine which regions of the belt 102 contain metals 104. The imaging system 125 may also be configured to determine visual characteristics of the metal 104 on the belt 102, including color, shape, texture, size, and other characteristics as are known in machine vision systems. The images from the imaging device 126 are sent to a computer 128.

The computer 128 may be separate from and connected to the controller 124, or may be a part of the controller 124 itself. The computer 128 is in communication with the imaging system 125 and with a system of ejectors 130 located downstream of the x-ray system 106. The ejectors 130 are used to separate a first category of metal from a second category of metal. The ejectors 130 may be used to sort the metals 104 into more than two categories, such as three categories, or any other number of categories of metals. The ejectors may be pneumatic, mechanical, or other as is known in the art. A recycle loop 132 may also be present downstream of the x-ray system 106. If present, the recycle loop 132 takes metals 104 that could not be categorized and reroutes them through the system 100 for rescanning and resorting into a category.

The imaging device 126 provides information to the controller 124 wherein image processing algorithms are used to determine a footprint of the metal 104 on the belt 102. In other words, the controller 124 now knows whether the dataset received at a given point of time at a given point of reference on the belt 102, belongs to a belt-only measurement or a metal measurement. If belt-only measurements are being taken, the controller 124 will use the dataset received to update background transmission, forward scatter, and back scatter values, which provide the background level of the belt 102 used in normalizing the dataset. In some cases, if the dataset measurement received by the controller 124 is different than a background dataset, the controller 124 assumes that a metal 104 particle is present on the belt 102 at that location.

Figure 2:
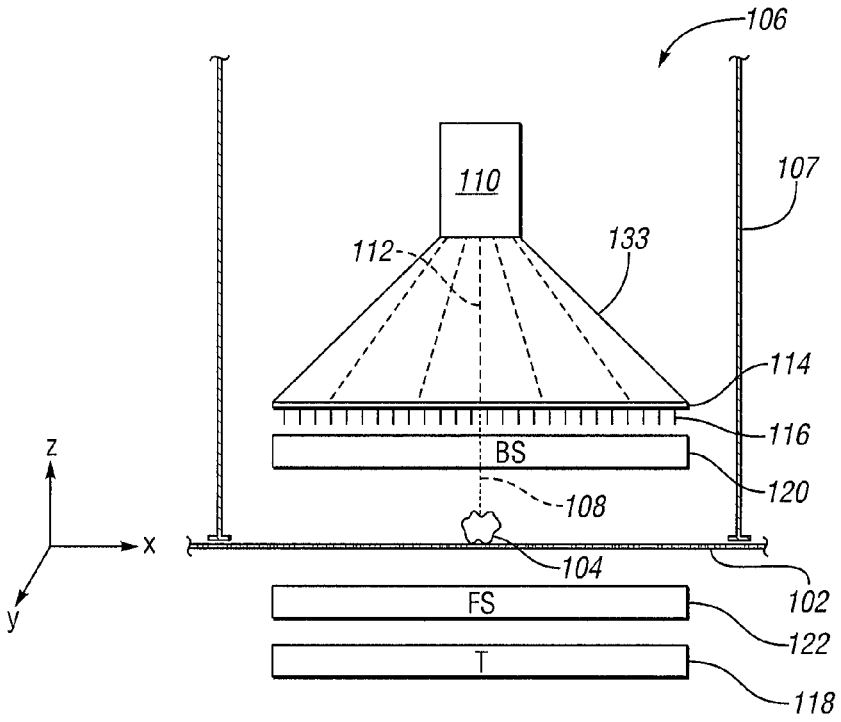
FIG. 2 is a schematic of the scrap metal sorting system of FIG. 1.

FIG. 2 depicts the x-ray system 106 taken along perpendicular to the plane of the scanning electron beam. The source 110 produces a scanning electron beam 112. The electron beam 112 sweeps along a planar path 133. The electron beam 112 interacts with the target foil 114 to produce a scanning x-ray beam 108, which is collimated to be generally perpendicular to the belt 102. The x-ray beam 108 interacts with a piece of metal 104 on the belt 102 and the resulting x-rays from the metal 104 are detected by the backscatter detectors 120, forward scatter detectors 122, and transmission detector 118.

The electron beam is illustrated as interacting with the target foil 114 to generate the x-ray beam using transmission. Alternatively, the electron beam may be positioned to scan generally in the x-y plane in the x-direction, and interact with the target foil 114 by reflection to produce a scanning x-ray beam 108 generally in the x-z plane in the x-direction. This alternate geometry may result in a higher efficiency for x-ray generation per milliamp at an equivalent keV as the transmissive x-ray generation described previously.

Figure 3:
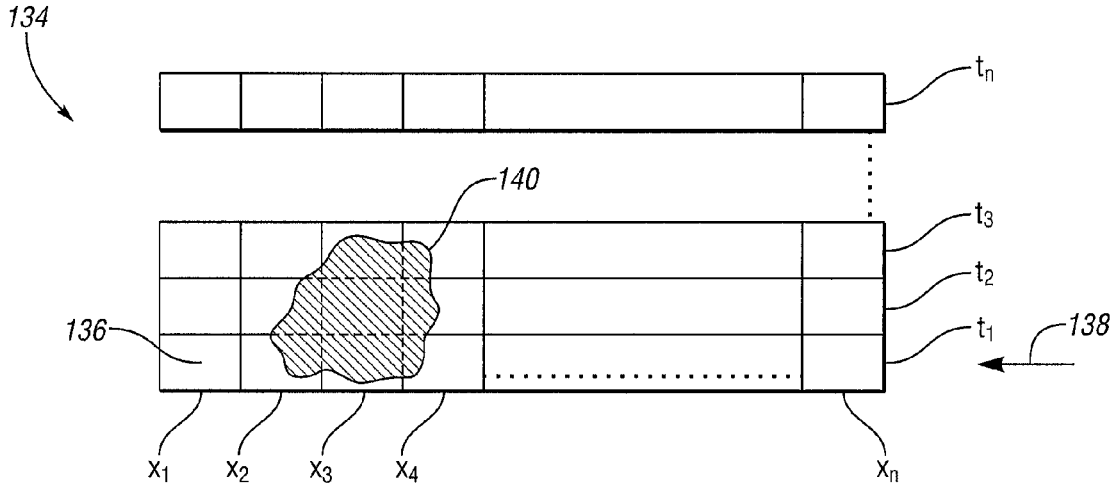
FIG. 3 is a schematic of a scan array for the metal sorting system of FIG. 1.

As the x-ray beam 108 scans across the belt 102, the scan may be a raster scan, back and forth scan, or other type of scan. The scan across the belt 102 along with the forward motion in the y-direction of the belt 102, leads to a matrix 134. The x-ray scan is discretized into small regions or pixels 136, i.e. x1, x2, up to and including xn. Each array 138 of pixels 136 is taken along one sweep of the scan and corresponds to a time, i.e. t1, t2, up to tn. The matrix 134 of times (ti) and arrays 138 relate to the speed of the belt 102. The size of the array 138 of pixels 136 is on the order of hundreds, and in one example is two hundred and forty. A piece of metal 104 can extend over multiple pixels 136 and multiple arrays 138. The metal 140 shown in FIG. 3 extends from x2 to x4 in the t1 and t2 arrays, and from x3 to x4 in the t3 array. Of course, the piece of metal 140 may extend over any number of pixels 136 or arrays 138. The imaging system 125 in FIG. 1 determines where the metal pieces 104 are located on the belt 102. The location coordinates (x, t) of the metals 104 on the belt 102 are communicated to the computer 128 and controller 124. The computer 128 controls the electron source 110. The controller 124 is in communication with the detectors and performs the data processing on the datasets to determine the category of metal 104.

In one example, the electron beam source 110 provides a continuous scanning electron beam 112, which in turn is a continuous scanning x-ray beam 108. The controller 124 receives the coordinates (x,t) of the metal 140 on the belt 102 from the imaging system 125 and computer 128 and only processes datasets metal 104 present with the cutoff plane. The background-only datasets may still be used to update the background dataset used in normalization. A normalized dataset calculation and determination of metal 104 category with the cutoff plane is only performed however on datasets with metal 104 being scanned.

In another example, the electron beam source 110 provides a directed scanning electron beam 112, which in turn is a directed scanning x-ray beam 108. The controller 124 receives the coordinates (x,t) of the metal 140 on the belt 102 from the imaging system 125 and computer 128, and only scans and processes datasets where metal 104 is present. The electron beam source 110 directs the electron beam 112 and x-ray beam 108 to only the regions of the belt 102 where metal 104 is present. This requires additional beam steering by the electron beam source 110. A background-only scan and dataset may occur at predetermined intervals to allow for updating the background dataset used in normalization. A normalized dataset and determination of metal 104 category is therefore performed on generally all datasets received, since datasets with no metal 104 present (or background-only datasets) have been minimized through the steered scanning.

If the metal 104 extends across only a few pixels 136 in one or more arrays 138, the resulting dataset may be inconclusive or blurred due to a smaller amount of metal 104 interacting with the x-ray beam 108 and a lower signal to noise ratio measured by the detectors 118, 120, 122. Generally, the topography of the metal 104 does not affect the categorization of the metal 104 by the controller 124.

For example, when scanning a metal, the transmission of x-rays decreases due to higher scattering and absorption by a metal. For any given percentage level of transmission, light metals such as Aluminum and Magnesium tend to scatter more than heavier metals with higher atomic number than Titanium, such as Iron, Nickel, or Lead. Titanium is generally between the two groups (light and heavy metals) and the scattering intensity can tend towards either one.

The thickness of the metal also affects the scattering signals. The forward scatter generated by an x-ray beam penetrating a metal typically increases at first, then reaches an optimum and then decreases, with increasing thickness.

Also, for thicker pieces of metal 104, the scattered and re-scattered x-rays expand through the volume of metal 104 and extend over a larger solid angle (steradian) upon exiting through the metal 104. This tends to increase the forward scatter x-ray measurements as a portion of the incident x-rays are sensed by the forward scatter detectors 122 instead of the transmission detector 118.

The backscattered signal is less affected by the thickness of the metal 104 since typically primarily weaker x-rays from near the surface of the metal 104 are backscattered and then sensed by the backscatter detector 120.

Figure 4:
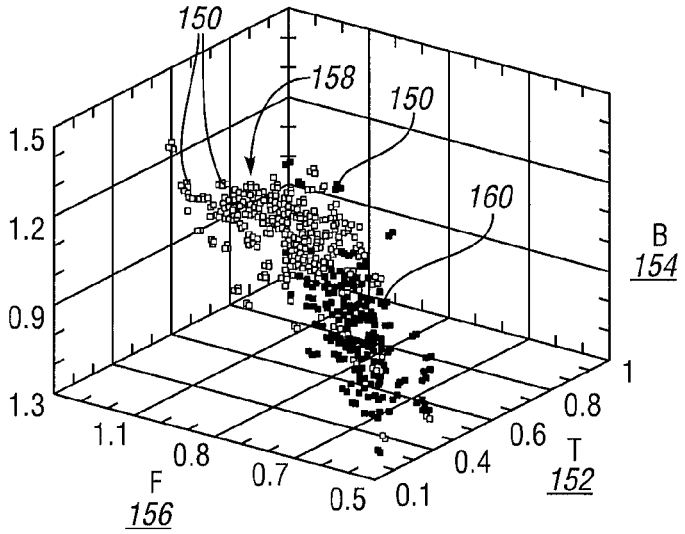
FIG. 4 is a three-dimensional plot of emitted x-ray measurements taken from two different metals by the sorting system of FIG. 1.

A series of normalized datasets 150 are shown in FIG. 4 as a function of transmission ratio 152, backscatter ratio 154, and forward scatter ratio 156. The ratio is the measured signal from a respective detector divided by the background value for that detector. For example, a transmission ratio is the transmitted x-rays through metal 104 divided by the transmitted x-rays through the belt 102 alone. A first category 158 and a second category 160 of metal 104 are shown. The datasets 150 may be from individual pixels 136 for a piece of metal 104, or may be an averaged pixel 136 value for a piece of metal 104.

Figure 5:
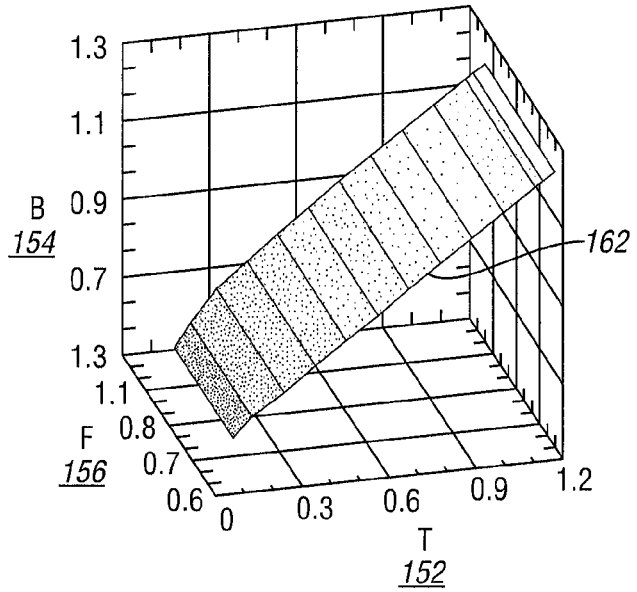
FIG. 5 is a three dimensional graph of a cutoff plane used with the sorting system of FIG. 1.

In an embodiment, the controller 124 compares the datasets 150 to a cutoff plane 162, shown in FIG. 5, which is also a function of forward scatter ratio 156, backscatter ratio 154, and transmission ratio 152. The sorting system 100 is provided with which categories of metals it is sorting between so an appropriate cutoff plane 162 is used by the controller 124. Different cutoff planes exist for each pairing of categories. For example, the cutoff plane 162 may be for Titanium and Stainless Steel, where Titanium is the first category 158 and Stainless Steel is the second category 160, or between other metals, or other materials. The dataset 150 will lie on either side of the cutoff plane 162, which allows for a determination of whether it falls into the first category 158 of metal 104, or the second category 160 of metal 104. If a dataset 150 is sufficiently close to or overlapping the cutoff plane 162, the metal 104 may fall into a third indeterminate category if one is so provided, and is resorted through the system 100 using the recycle loop 132.

Basic category groupings for metals 104 include: heavy and light metal, heavy metal and Titanium, light metal and Titanium, heavy and superheavy (i.e. lead) metal, wrought metal and cast (i.e. higher Copper content) metal, low alloy wrought metal and high alloy (i.e., higher Zinc content) wrought metal, and Aluminum and Magnesium (may require directed beam steering scanning). Other groupings, such as scrap plastics, are also contemplated.

Figure 6:
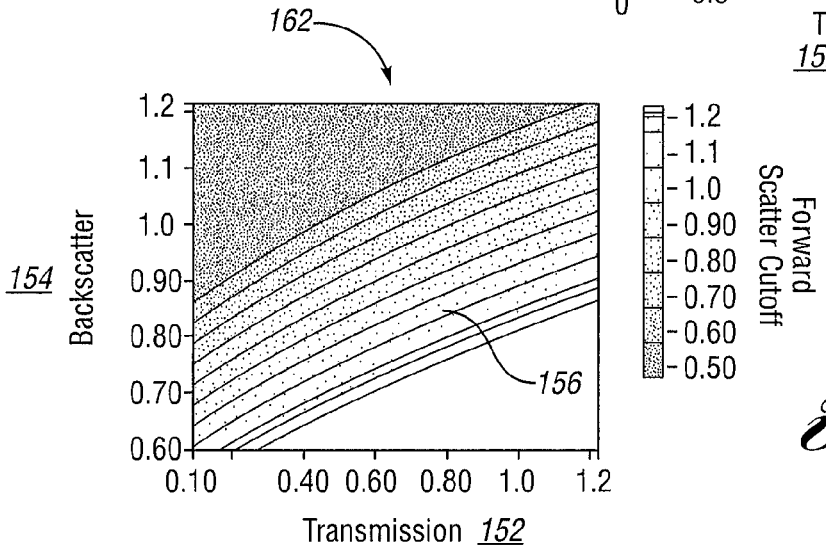
FIG. 6 is a two-dimensional graph of the cutoff plane of FIG. 5.

The cutoff plane 162 is shown in a two dimensional view in FIG. 6 with the backscatter ratio 154 plotted against the transmission ration 152. The forward scatter ratio 156 is shown in varying degrees using shading.

The cutoff plane 162 is determined through calibration of the sorting system 100 using categories and groupings of metals 104 that are planned for sorting. For example, the cutoff plane 162 is determined using an empirical calculation based on test datasets. In another example, the cutoff plane calibration is determined using a support vector machine, which is a mathematics technique for a non-linear calibration in multiple dimensions. The plane-defining support vector machine score cutoff is typically set to zero. The cutoff plane may also be shifted towards a lower density material or a higher density material by setting a plane-defining support vector machine score cutoff to a non-zero value to minimize errors for the lower density material or the higher density material. Alternatively, the support vector machine may be used directly to categorize and sort the materials instead of using the cutoff plane, and may be calibrated during testing. Of course, other mathematics models and techniques for calibration are contemplated including a neural network, or other classifier.

The cutoff plane 162, once calibrated, is stored in a database 164 in communication with the controller 124. The controller 124 enters the normalized transmission ratio (or x-ray) and the normalized backscatter ratio (or x-ray) from a dataset with the database 164, and compares the normalized forward scatter ratio (x-ray) to the cutoff plane 162 to sort between the first and second category of metal 104. The normalized dataset may relate to a pixel 136 or larger region of the metal 104, or may relate to an average value for the metal 104 based on the footprint.

In other words, the controller 124 receives a transmission, backscatter, and forward scatter signal from the detectors 118, 120, 122, respectively. These signals are normalized by a background measurement or signal from a background-only dataset. For example, a transmission ratio is found by dividing the metal 104 transmission signal for a pixel 136 by a background transmission signal for the pixel 135, to create a normalized dataset. The controller 124 uses the cutoff plane 162 to determine the category of metal 104.

The controller 124 locates the normalized dataset on FIG. 6 using the transmission ratio and backscatter ratio. The controller 124 then compares the forward scattered ratio to the value of the cutoff plane 162 at that location on the plot. If the forward scatter ratio is higher than the cutoff plane 162 value, the region or pixel 136 of metal 104 is in the first category. If the forward scatter ratio is lower than the cutoff plane 162, the region or pixel 136 of metal 104 is in the second category. If the forward scatter ratio is within a certain value or percentage of the cutoff plane 162, the region or pixel 136 of metal 104 is in an indeterminate category, cannot be clearly classified and may be placed in a third category. Based on the category of metal 104, the controller 124 interfaces with the ejector system 130 for sorting the metal 104 based on the category and location on the belt 102. Of course, the controller could also compare a backscatter ratio to a cutoff plane, or a transmission ratio to a cutoff plane as well.

The controller 124 may integrate the datasets for an individual particle or piece of metal 104 before making a sorting decision. In one example, the controller 124 calculates the sum of the normalized forward scatter ratios (x-rays) from all of the datasets in a particle and the sum of the cutoff plane values corresponding to the datasets transmission and backscatter ratios for the particle. The controller 124 compares the sum of the normalized forward scatter ratios to the sum of the cutoff plane values to sort between the first and the second category.

In another example, the controller 124 calculates the sum of the normalized forward scatter ratios (x-rays) per the total number of pixels 136 (region) for the particle, calculates the sum of the normalized transmission ratios (x-rays) per the total number of pixels 136 (region) for the particle, and calculates the sum of the normalized back scatter ratios (x-rays) per the total number of pixels 136 (region) for the particle. The controller 124 uses the sum of the normalized transmission ratios per total number of pixels 136, and the sum of the normalized back scatter ratios per total number of pixels 136 to determine a total average cutoff plane value for the particle from the database 164. The controller 124 compares the sum of the normalized forward scatter ratios per the total number of pixels 136 to the total average cutoff plane value to sort between the first and the second category of metal 104 for the particle of metal 104 as a whole.

Figure 7:
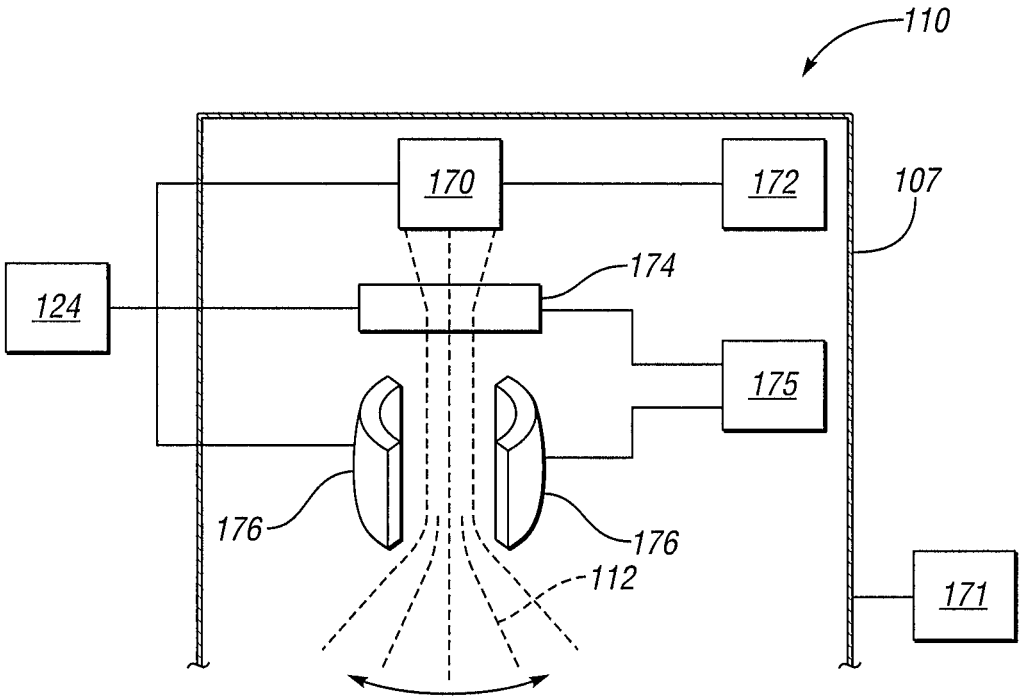
FIG. 7 is a schematic of an electron source according to an embodiment.

The electron beam source 110, shown in FIG. 7, provides an electron beam 112. The electron beam source 110 is shielded by a shield 107 and is operated at a specified vacuum pressure to reduce scattering of the electron beam 112 by air. A vacuum system 171 provides the desired vacuum pressure, and may include a pump, multi-staged pumps, and/or various types of pumps as are known in the art. An electron beam generator 170 is powered by a power supply 172. In one example, the electron beam generator 170 is operated at 120 keV and 2 mA, and powered by a power supply 172 capable of providing 3 kW. The electron beam generator 170 may be operated at higher or lower electronvolts or current based on the metal 104 in the sorting system 100. The electronvoltage is typically lowered for certain classifications, such as Aluminum versus Titanium. When lowering the electronvoltage, typically the amperage needs to be increased, for example up to 50 mA. The electron voltage may be increased for other classifications, such as Lead versus Zinc. If the electronvoltage is increased to a high value, shielding of the x-rays may become an issue.

The electron beam 112 provided by the generator 170 is focused using an electromagnetic focusing coil 174 driven by a power supply 175, which functions as a lens for the generated beam. The focusing coil 174 may be a set of windings. Additional focusing coils 174 for focusing or collimating the beam 112 may be provided as necessary.

The beam 112 then travels through a beam steering coil 176 also powered by the power supply 175, or an additional power supply. The beam steering coil 176 acts to swing the beam back and forth along a plane using varying electromagnetic fields, which creates the scanning motion, also known as beam deflection. The steering coils 176 may be saddle shaped.

Figure 8:
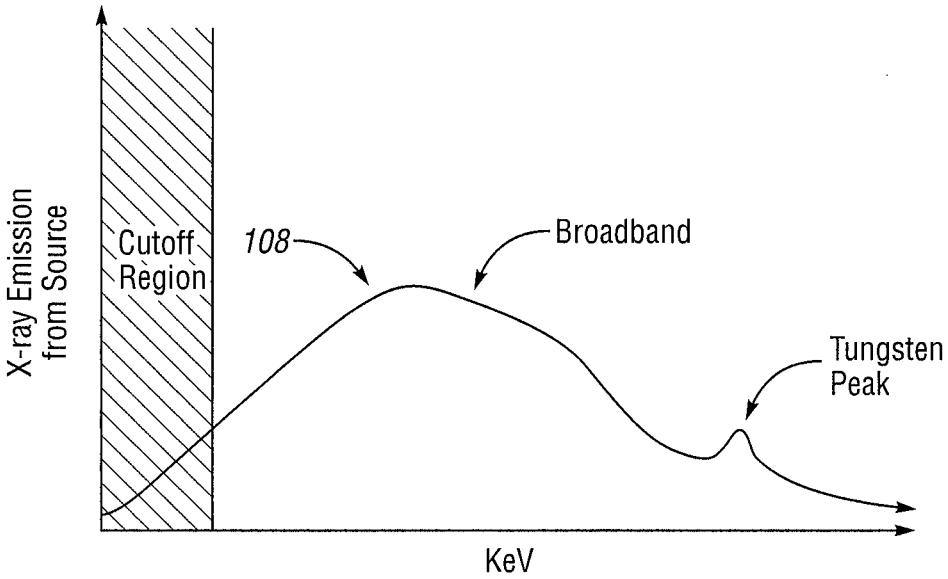
FIG. 8 is a graph of the x-ray source intensity as a function of kiloelectron volts (keV) for the x-ray source of FIG. 7.

The electron beam 112 then interacts with the foil 114 to produce an x-ray 108 beam as shown in FIG. 8. FIG. 8 plots x-ray beam strength as a function of kiloelectron volts (keV). For example, a 120 keV electron source produces 0-120 keV of x-ray photons. The continuous broadband peak shown is due to Bremsstrahlung x-rays. The smaller sharper peak is due to characteristic x-rays emitted by Tungsten, or other metal in the target foil 114. The cutoff region, at low values of keV, does not escape past the x-ray enclosure or shielding 107 to the belt 102.

The beam generator 170, focusing coil 174, and steering coil 176 are in communication with the controller 124 to provide the location of the beam 108 with respect to the belt 102 and pixels 136.

In one example, the scanning x-ray beam 108 scans at approximately 300 cycles per second, where a cycle is a scan across and back. The belt travels at approximately six hundred feet per minute, ten ft/s, or three mm/ms. This equates to the x-ray beam 108 scanning ten mm of belt 102 per cycle. Of course, other scanning rates and belt travel rates are contemplated.

For the case where the electron beam source 110 directs the electron beam 112 and x-ray beam 108 to only the regions of the belt 102 where metal 104 is present, the source 110 may require the addition of an H-bridge and field effect transistors (FETs) to provide the additional steering. A calibrated table containing voltages to direct the beam 112 from a first position directly to a second position is also used for the steering coil 176.

Figure 9:
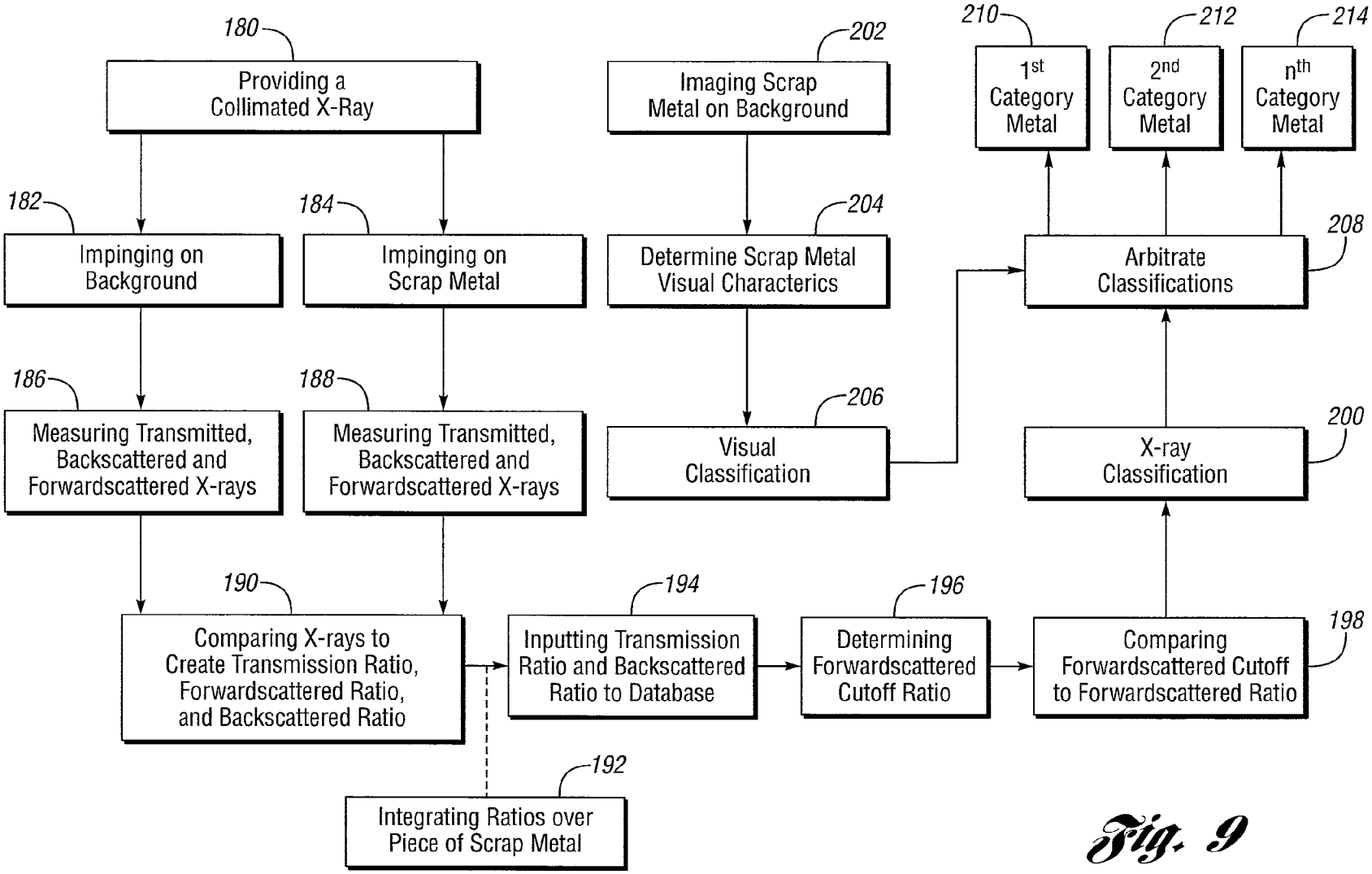
FIG. 9 is a schematic of a process flow for use with the scrap metal sorting system of FIG. 1.

FIG. 9 illustrates a process flow diagram for the sorting system 100 shown in FIG. 1, using the cutoff plane 162 as shown in FIGS. 5 and 6. The system provides a collimated x-ray beam at step 180. The x-ray beam is impinged on the background material at step 182, and on the scrap metal at step 184. The transmitted, forward scattered, and back scattered x-rays from the background material are measured by the detectors at step 186. The transmitted, forward scattered, and back scattered x-rays from the scrap metal are measured by the detectors at step 188. The datasets from step 186 and step 199 are compared at step 190, where a transmission ratio, forward scatter ratio, and back scatter ratio are calculated. In some embodiments, the ratios are averaged or be otherwise mathematically manipulated at step 192 (shown in phantom). The transmission and back scatter ratios are input into a database at step 194. The forward scatter cutoff ratio is determined at step 196 using the cutoff plane, as is shown in FIG. 6. The forward scatter ratio is compared to the forward scatter cutoff ratio in step 198. Depending on whether the forward scatter ratio is greater than or less than the forward scatter cutoff ratio, the scrap metal is classified into categories based on the x-ray information at step 200.

In some embodiments, a machine vision system with a camera 126 and vision computer 128 is also used in sorting the scrap metal. The camera 126 images the scrap metal on the background and transmits data to the vision computer 128 at 202. The vision computer 128 determines visual characteristics of the scrap metal pieces on the background at 204. For example, a visual characteristic may include color, texture, shape, aspect ratio, or other machine vision determinable characteristic. The vision computer 128 may assign one or more visual characteristic to a piece of scrap metal. The scrap metal is then classified into categories based on the visual characteristics at 206.

The spectroscopy computer 124 or vision computer 128 then arbitrates at 208 between the x-ray and vision classifications for the scrap metals. Various arbitration techniques may be used such as Boolean, probabilistic, Bayesian, a combination of Boolean and Bayesian, support vector machine, neural network, or other classification and arbitration techniques.

The scrap metals are then sorted into a first category at step 210, a second category at step 212, and additional categories as desired, up to n categories at step 214.

Figure 10:
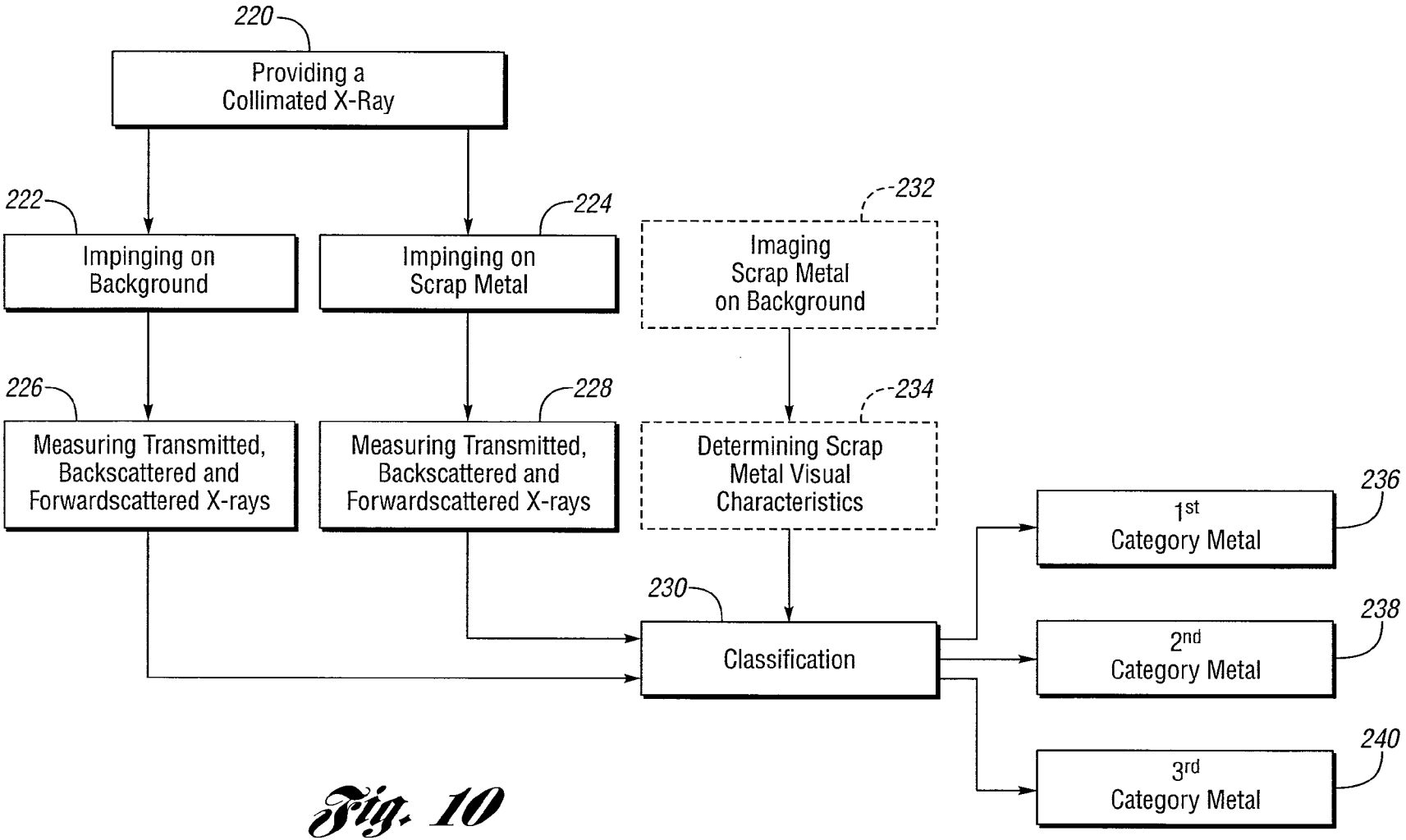
FIG. 10 is a schematic of another process flow for use with the scrap metal sorting system of FIG. 1.

Another example of a process flow diagram for the sorting system 100 is shown in FIG. 10. The system provides a collimated x-ray beam at step 220. The x-ray beam is impinged on the background material at step 222, and on the scrap metal at step 224. The transmitted, forward scattered, and back scattered x-rays from the background material are measured by the detectors at step 226. The transmitted, forward scattered, and back scattered x-rays from the scrap metal are measured by the detectors at step 228. The datasets from step 226 and step 228 are input into a classification at 230. The results of steps 226 and 228 may be combined in an additional step before the classification 230 or within the classification 230 to create a transmission ratio, forward scattered ratio, and back scattered ratio for use in classifying the scrap metal.

A machine vision system with a camera 126 and vision computer 128 may also be used in sorting the scrap metal. The camera 126 images the scrap metal on the background and transmits data to the vision computer 128 at 232. The vision computer 128 determines visual characteristics of the scrap metal pieces on the background at 234. For example, a visual characteristic may include color, texture, shape, aspect ratio, or other machine vision determined characteristic. The vision computer 128 may assign one or more visual characteristic to a piece of scrap metal. The visual characteristic is input into the classification step at 230.

During the classification step, each piece of scrap metal is sorted into one of two or more predetermined categories, such as categories 236, 238, 240. The controller determines which category the scrap metal belongs to by combining both the visual characteristic data and the x-ray datasets.

Various classification techniques may be used such as Bayesian, support vector machine, neural network, or other classification techniques.

In one example, the classifier is a support vector machine, which is used to directly sort the metals. In another example, the classifier is based on a cutoff plane as discussed previously, and the support vector machine or another technique is used to calibrate the system.

Alternatively, the visual and x-ray data may be combined and then classified using probabilistic techniques, such as Bayesian calculations where the vision and x-ray portions each provide a Bayes factor. The posterior odds of a metal belonging to a given category are the product of the prior odds and the two Bayes factors. An example of prior odds is how common a given category of metal is within the feed. In yet another example, the visual and x-ray data may be combined and classified using switching algebra and logic, such as Boolean functions.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An apparatus for sorting scrap metals comprising:

a conveyor belt for carrying at least two categories of scrap metals positioned at random, the conveyor belt traveling in a first direction;

an electron beam source for creating a scanning electron beam;

a target foil positioned to interact with the scanning electron beam to create a scanning x-ray beam along a plane generally transverse to the first direction of the conveyer belt and directed towards the scrap metals on the conveyor belt;

at least one backscatter detector configured to measure at least one of elastically and inelastically backscattered x-rays from the scrap metals on the conveyor belt;

at least one forward scatter detector configured to measure at least one of elastically and inelastically forward scattered x-rays from the scrap metals on the conveyor belt;

a transmission detector for measuring transmitted x-rays through the scrap metals on the conveyor belt;

a database containing a cutoff plane between a first category of the scrap metal and a second category of the scrap metal, the cutoff plane a function of transmission x-rays, backscatter x-rays, and forward scatter x-rays; and a controller configured to (i) receive transmitted x-rays, forward scattered x-rays, and backscattered x-rays detected from the scrap metal as a dataset, (ii) normalize the dataset using detected x-rays from the conveyor belt, and (iii) compare the normalized dataset to the cutoff plane in the database to categorize the scrap metals into one of the first and the second category.

2. The apparatus of claim 1 further comprising a vision system located upstream of the electron beam source to image the metals on the conveyor belt;

wherein the controller is configured to (iv) determine a visual characteristic of the metals to categorize the scrap metals into one of the first and the second category.

3. The apparatus of claim 1 wherein the cutoff plane is based on the forward scatter x-ray.

4. The apparatus of claim 3 wherein the controller is configured to enter the normalized transmission x-ray and the normalized backscatter x-ray from the dataset into the database, and compare the normalized forward scatter x-ray to the cutoff plane to sort between the first and second category of metal.

5. The apparatus of claim 1 wherein each dataset corresponds to a region in a piece of the scrap metal.

6. The apparatus of claim 5 wherein for the piece of scrap metal, the controller is configured to calculate the sum of the normalized forward scatter x-rays from the dataset and the sum of a value from the cutoff plane and compare the sum of the normalized forward scatter x-rays to the sum of the cutoff plane values to sort between the first and the second category.

7. The apparatus of claim 5 wherein for the piece of scrap metal, the controller is configured to calculate the sum of the normalized forward scatter x-rays per region, calculate the sum of the normalized transmission x-rays per region and sum of the normalized back scatter x-rays per region to determine a cutoff plane value in the database, and compare the sum of the normalized forward scatter x-rays per region to the cutoff plane value to sort between the first and the second category.

8. The apparatus of claim 1 wherein the database is formed using an empirical calculation from a test to provide the category of metal.

9. The apparatus of claim 1 wherein the controller is configured to use a support vector machine for calibration, the cutoff plane being derived from the support vector machine.

10. The apparatus of claim 9 wherein a plane-defining support vector machine score cutoff is set to zero.

11. The apparatus of claim 9 wherein the cutoff plane is shifted towards one of a lower density metal and a higher density metal by setting a plane-defining support vector machine score cutoff to a non-zero value to minimize errors within one of the lower density metal and the higher density metal.

12. The apparatus of claim 1 further comprising an imaging camera configured to image the metals on the conveyor belt to direct data processing by the controller to at least one region of the conveyor belt carrying metals.

13. The apparatus of claim 1 further comprising a collimator interposed between the target foil and the conveyor belt to collimate the x-rays.

14. The apparatus of claim 13 wherein the target foil further comprises at least one of tantalum, titanium and tungsten, and carbon and tungsten.

15. The apparatus of claim 1 wherein the transmission detector is aligned with the plane of scanning x-rays.

16. The apparatus of claim 1 wherein the backscatter detector is positioned adjacent to the plane of scanning x-rays and the electron beam source.

17. The apparatus of claim 1 wherein the forward scatter detector is positioned adjacent to the plane of scanning x-rays and the transmission detector.

18. The apparatus of claim 1 wherein the at least one backscatter detector is a scintillator with at least one photomultiplier tube.

19. The apparatus of claim 1 wherein the electron beam source further comprises an electron beam generator, a focusing coil, and beam steering coils.

20. The apparatus of claim 19 wherein the electron beam from the electron beam source scans as a raster.

21. The apparatus of claim 12 wherein the electron beam and corresponding x-ray beam are directed by the imaging camera to scan regions of the conveyor belt containing metals to be sorted.

22. The apparatus of claim 1 wherein the scrap metal further comprises an indeterminate category such that the controller sorts the indeterminate category into a recycle loop for rescanning by the apparatus.

23. The apparatus of claim 1 further comprising at least one ejector positioned adjacent to the conveyor belt and downstream of the plane of x-rays to physically sort the first category of scrap metal from the second category of scrap metal.

24. A method for sorting scrap metals comprising:

impinging a collimated x-ray on a background material;

impinging a collimated x-ray on a portion of a piece of scrap metal provided on the background material, the scrap metal containing a first and a second category of metal;

measuring and comparing transmitted x-rays from the portion of scrap metal and the background material to create a transmission ratio;

measuring and comparing forward scattered x-rays from the portion of the scrap metal and the background material to create a forward scatter ratio;

measuring and comparing backscattered x-rays from the portion of the scrap metal and the background material to create a backscatter ratio;

inputting the transmission ratio and backscatter ratio into a database to obtain a forward scatter cutoff value, which provides a division between the first category of metal and the second category of metal;

comparing the forward scatter ratio to the forward scatter cutoff value; and sorting the piece of scrap metal into one of the first category and the second category based on the forward scatter cutoff value.

25. The method of claim 24 further comprising imaging the piece of scrap metal to determine a visual characteristic;

wherein the piece of scrap metal is sorted based on the visual characteristic.

26. The method of claim 24 further comprising:

obtaining a transmission ratio, a forward scatter ratio, and a backscatter ratio from each portion of the piece of scrap metal;

calculating a sum of the forward scatter ratios over the piece of scrap metal;

calculating a sum of the total forward scatter cutoff values from the database; and comparing the sum of the forward scatter ratios to the sum of the forward scatter cutoff values to sort the piece of scrap metal between the first and the second category.

27. The method of claim 24 further comprising:

obtaining a transmission ratio, a forward scatter ratio, and a backscatter ratio from each portion of the piece of scrap metal;

calculating the sum of the forward scatter ratios over the piece per the number of portions in the piece of scrap metal;

calculating the sum of the backscatter ratios over the piece per the number of portions in the piece of scrap metal and the transmission ratios over the piece per the number of portions in the piece of scrap metal to obtain a forward scatter cutoff value for the piece from the database; and comparing the sum of the forward scatter ratios per the number of portions to the forward scatter cutoff value for the piece to sort the piece of scrap metal between the first and the second category.

28. The method of claim 24 wherein the background material comprises a conveyor belt.

29. The method of claim 24 further comprising sorting the metal into a third category of metal adjacent to the forward scatter cutoff value; and resorting the metal in the third category.

30. The method of claim 24 further comprising forming a collimated x-ray beam using an electron beam source and a target foil.

31. The method of claim 24 further comprising ejecting the first category of metal from the background material.

32. An apparatus for sorting scrap metal containing at least two categories of metals, the apparatus comprising:

an x-ray beam directed towards at least a portion of a particle of scrap metal;

at least one backscatter detector for measuring a backscattered x-ray from the particle;

at least one forward scatter detector for measuring a forward scattered x-ray from the particle;

a transmission detector for measuring a transmitted x-ray through the particle; and a controller configured to compare the transmitted x-ray, the forward scattered x-ray, and the backscattered x-ray from the particle of scrap metal to a cutoff plane in a database, thereby x-ray classifying the metals into at least two categories.

33. The apparatus of claim 32 further comprising a vision system to determine a visual characteristic of the scrap metal;

wherein the controller uses the visual characteristics to visually classify the metals into the at least two categories.

34. The apparatus of claim 33 wherein the controller arbitrates between x-ray classification and the visual classification to sort the metals into the at least two categories.

35. The apparatus of claim 34 wherein the controller arbitrates using a probabilistic routine.

36. The apparatus of claim 34 wherein the controller arbitrates using a support vector machine.

37. The apparatus of claim 34 wherein the controller arbitrates using a Boolean routine.

* * * * *